US005787832A

United States Patent [19]

Spinka

[11] Patent Number: 5,787,832

[45] Date of Patent: Aug. 4, 1998

[54] METHOD AND APPARATUS TO STABILIZE MARINE VESSELS

[76] Inventor: Harold Spinka, 635 S. Loomis, Naperville, Ill. 60540

[21] Appl. No.: 740,196

[22] Filed: Oct. 24, 1996

Related U.S. Application Data

[63] Continuation-in-part of Ser. No. 599,747, Feb. 12, 1996, abandoned.

[51] Int. Cl.[6] ..... B63B 43/14

[52] U.S. Cl. ..... 114/123; 114/122

[58] Field of Search ..... 114/121, 123, 114/126, 122, 270, 275, 283, 144 E; 340/984

[56] References Cited

U.S. PATENT DOCUMENTS 5,511,504 4/1996 Martin ..... 114/126

FOREIGN PATENT DOCUMENTS 0077591 4/1986 Japan ..... 114/123

*Primary Examiner*—Ed L. Swinehart

*Attorney, Agent, or Firm*—Trexler, Bushnell, Giangiorgi & Blackstone, Ltd.

[57] ABSTRACT

A stabilizer system is used to stabilize a marine vessel hull. The system includes at least one stabilizer assembly attached to the hull and the stabilizer assembly is capable of moving with respect to the hull in response to ambient sea surface conditions detected by the system. Each stabilizer assembly includes an outrigger arm and a float arm which has a float attached to one end. The float arm can expand and contract in order to keep the float in contact with the sea surface or lift it from contact. Additionally, the float can have the ability to change its cross-sectional shape and volume with respect to the waves. The entire stabilizer assembly, and various components thereof, have the ability to position themselves in response to commands generated by the system. The system predicts impending adverse motions, such as oncoming waves, in order to position the stabilizer assemblies and the vessel in optimum positions so as to negate the effect of the oncoming wave on the vessel.

23 Claims, 8 Drawing Sheets

FIG. 6
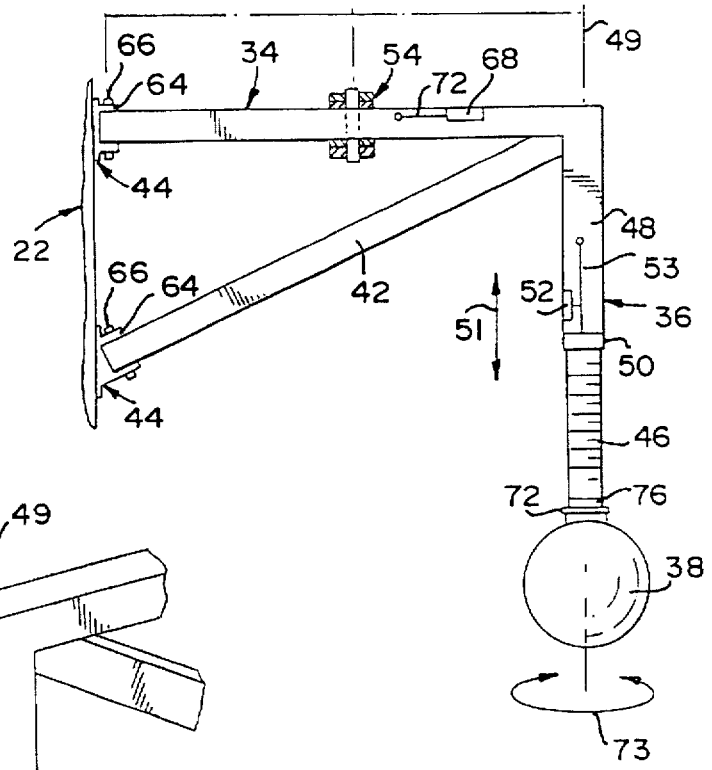
FIG. 8
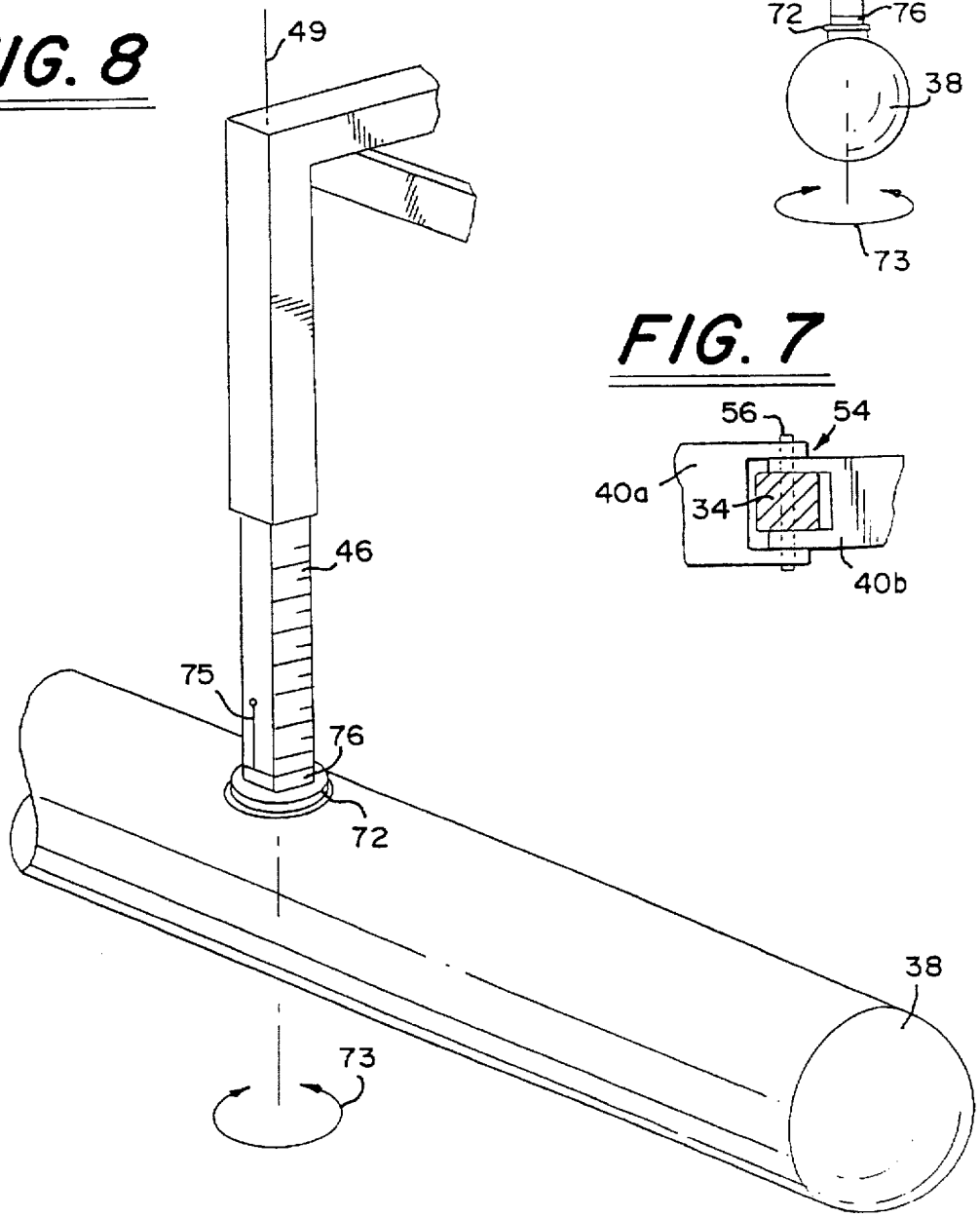
FIG. 7

FIG. 9a
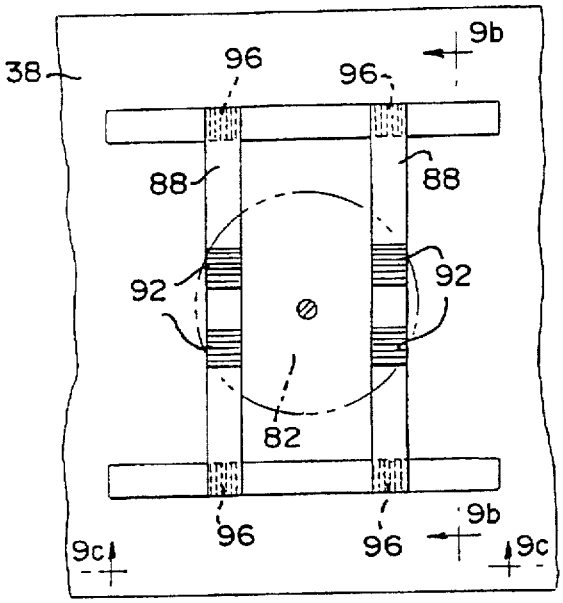
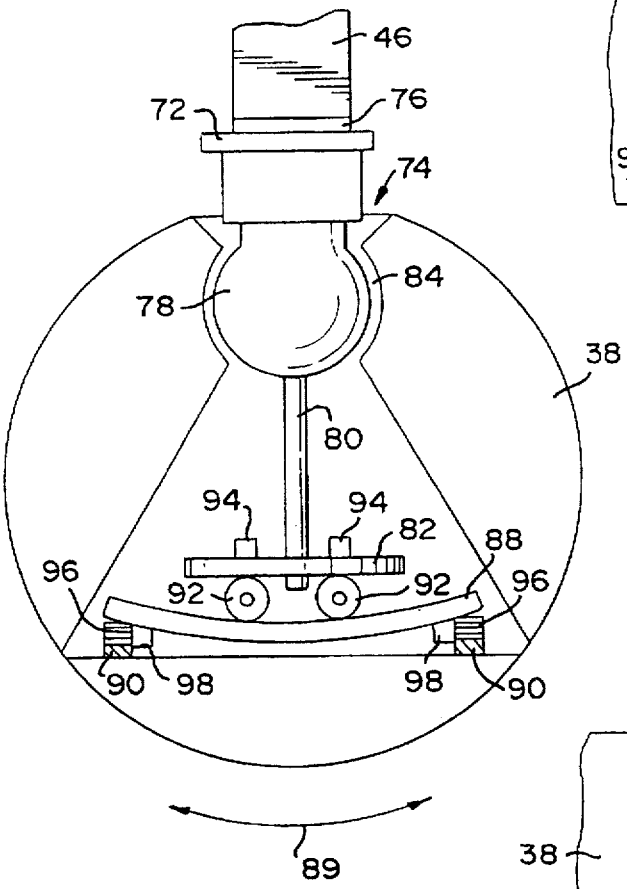
FIG. 9b
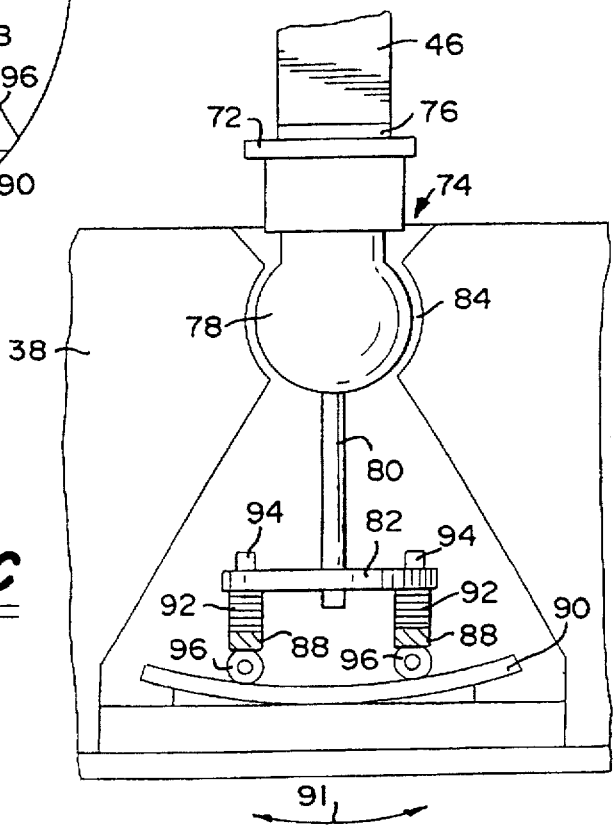
FIG. 9c

FIG. 11
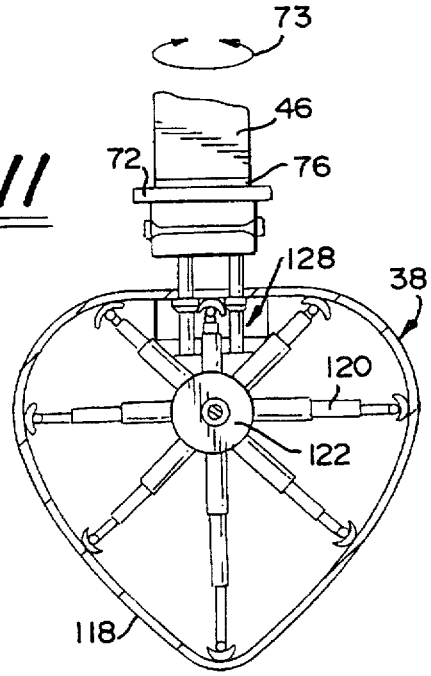
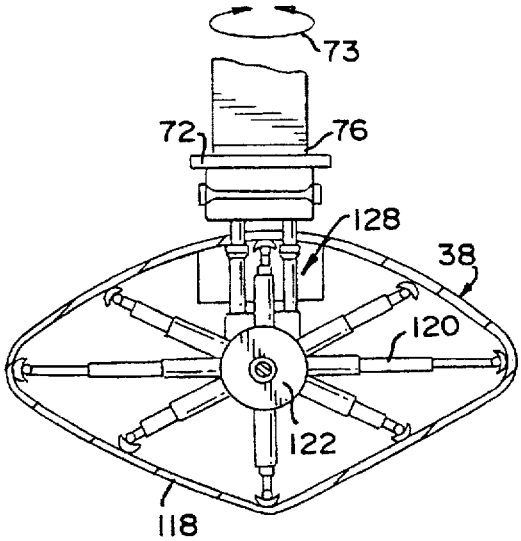
FIG. 12
FIG. 13
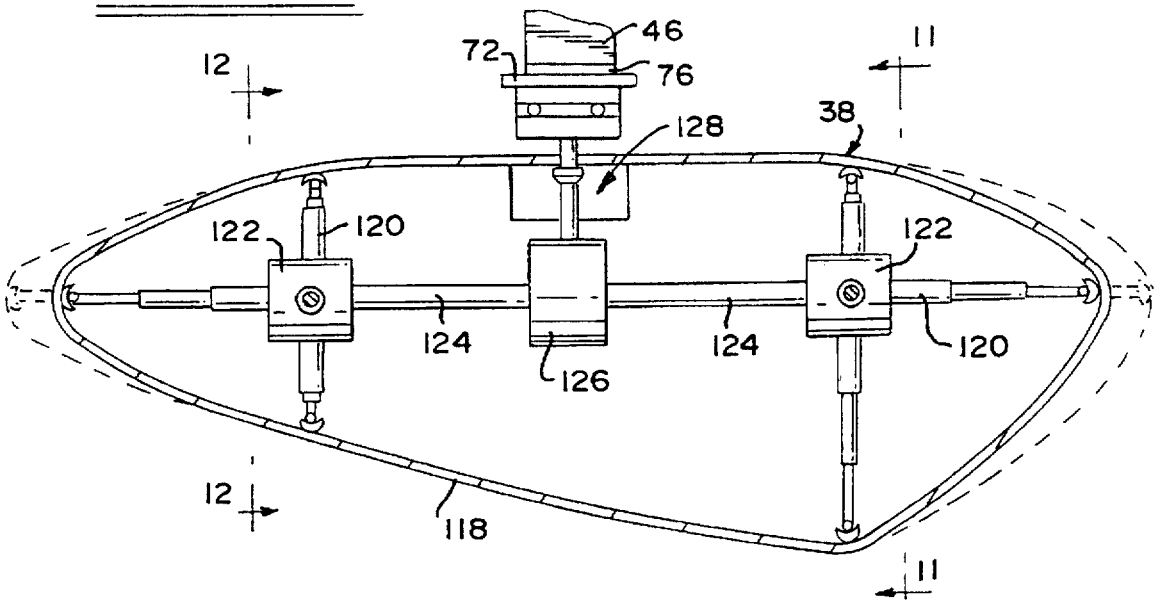

FIG. 14

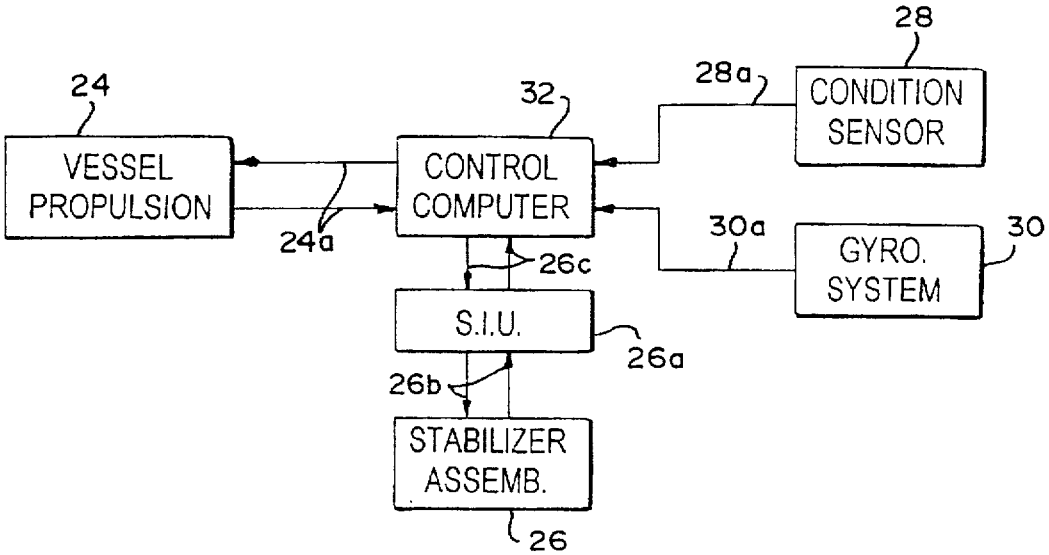

STEP 1: SENSE AMBIENT SEA SURFACE CONDITIONS

STEP 2: REFERENCE CONDITIONS SENSOR READINGS AGAINST GYROSCOPIC SYSTEM

STEP 3: GENERATE SEA SURFACE MODEL AND ESTIMATE WAVE VELOCITIES

STEP 4: SENSE INDIVIDUAL STABILIZER ASSEMBLIES AND INDIVIDUAL STABILIZER COMPONENTS

STEP 5: INPUT AND INTERPOLATE DATA IN CONTROL COMPUTER

STEP 6: ANALYSIS OF PROCESSED DATA BY CONTROL COMPUTER - CALCULATE FORCES ON VESSEL

STEP 7: CALCULATION OF VESSEL BEHAVIOR PREDICTION

STEP 8: POSITION STABILIZER ASSEMBLIES AND VESSEL

STEP 9: REPEAT STEP 1 THROUGH STEP 8

METHOD AND APPARATUS TO STABILIZE MARINE VESSELS

CROSS-REFERENCE

This is a Continuation-In-Part of application Ser. No. 08/599,747, Filed Feb. 12, 1996 entitled "Method And Apparatus To Stabilize Marine Vessels", now abandoned.

BACKGROUND OF THE INVENTION

This invention relates to a novel marine vessel stabilizing system, and more particularly to an active stabilizing arrangement for reducing the pitching, rolling, and yawing motions of a marine vessel hull floating on a sea surface.

Marine vessels in heavy seas undergo considerable changes in vertical position and orientation when their vessel lengths are comparable to or shorter than the wavelength of water surface waves. Of particular concern are situations where the marine vessel is in heavy seas, with distance between wave crests one or more times greater than the length of the vessel. In this situation, a "resonance" condition of the marine vessel's orientation with respect to surface waves can occur, with that the resistance to the forward motion of the vessel is increased as waves crash over the forward area of the marine vessel.

Numerous marine vessels have been equipped with some type of apparatus to reduce the pitching, rolling, or yawing motion of a vessel floating on a sea surface. The need for reducing the undesired motion of a floating marine vessel hull is evident when examining the various uses of marine vessels. For example, marine vessels are used to load, unload, and transport goods (cargo vessels), transport people (ferries and passenger liners), conduct scientific experiments (research vessels), extract valuable commodities and resources (offshore drilling rigs), provide sources of power (offshore electrical generating stations), conduct repair work to water structures (floating platform barges), and a variety of other useful applications. The need to effectively provide a stable marine vessel hull is based upon safety considerations of personnel and passengers on the vessels, efficiency of the marine vessel to perform its intended function, and comfort of the personnel and passengers on these vessels.

In an attempt to provide for vessel stability, prior art stabilizing apparatuses have included the use of stabilizing fins, stabilizing foils, pontoons/outriggers, ballast tank systems, and even hull modifications. However, the current systems in use are passive, in that they do not respond to an impending adverse motion, such as oncoming waves or winds, but rather act in response to a presently occurring or past wave. These passive systems, in other words, do not attempt to position the vessel or the various stabilizing assemblies in a position to effectively negate the impending wave motion in order to stabilize the vessel itself. Rather, the passive systems react to the wave as it is occurring or after it has occurred as a corrective action, in effect trying to limit the undesired response of the vessel as a result of the wave motion on it. When the passive systems react to the current wave motion, the system usually creates a counteracting force after the effect of the wave, usually too late in time to be of any significant effect on vessel stability.

In contrast to the passive systems of the prior art, the present invention is an active system which is able to continuously analyze the surrounding sea surface conditions and atmospheric conditions and predict their effect on the marine vessel. The active system of the present invention allows for the continuous optimal positioning of the marine vessel and stabilizing apparatus in order to effectively negate the impact forces of the impending wave motion. By effectively negating the impact forces of the impending wave motion, the stability, safety, and efficiency of the vessel is greatly enhanced. Other features and advantages of the present invention will become apparent upon a reading of the attached specification.

OBJECTS AND SUMMARY OF THE INVENTION

A general object of the present invention is directed to a novel system and method for continuously stabilizing a marine vessel that can predict the vessel's response to impending wave motion and enact stabilizing assemblies to effectively negate the effect of that motion, instead of merely correcting the marine vessel's response after an undesired wave motion.

Another objective of this invention is to provide a stable surface on a marine vessel upon which personnel and passengers may work and traverse.

A further objective of this invention is to provide for the economic and efficient use of a marine vessel in the manner for which that particular marine vessel was designed to perform.

Yet another objective of the present invention is to provide a stabilizing system which rapidly operates in response to impending adverse motion and allows for the effective negation of any impending wave motion.

Briefly, and in accordance with the foregoing, the present invention discloses a novel stabilizer assembly extending from and connected to a marine vessel hull floating upon a water or sea surface. The stabilizer assembly includes a plurality of outrigger arms extending laterally from the marine vessel with a downwardly extended float arm operatively connected thereto. Each float arm has a float connected thereto which is kept in contact with the water to aid in stabilizing the ship. Alternatively, the float may be lifted completely out of its contact with the water to reduce drag, or as required in the event of marine vessel docking procedures. Additionally, each stabilizer assembly also has at least one support arm, which is capable of expanding or contracting and is operatively connected between the vessel hull and the outrigger arm allowing for lateral movement of the outrigger arm, float arm, and float with respect to the vessel hull.

The present invention utilizes a novel system and method to stabilize the marine vessel. The marine vessel is equipped with a gyroscope system and sensors; the sensors being mounted and oriented on the marine vessel so as to provide an unobstructed sensing path of the ambient sea surface conditions. Specifically, the sensors, which may be located on the vessel or on the stabilizer assembly or both, sense the ambient sea surface and atmospheric conditions relative to the position of the marine vessel as a function of time in order to estimate wave velocity and changing wave profiles relative to the marine vessel.

These sea surface sensor readings are then referenced against information provided by the marine vessel's gyroscopic system, wherein the gyroscopic system accounts for differences in sensor orientation as the pitch, roll, and yaw of the marine vessel changes with respect to time. The sea surface sensor readings and gyroscopic system readings are then processed together as a function of time and are inputted, along with the individual stabilizer assembly positions with respect to vessel, into a control computer located on the marine vessel.

The control computer interpolates the sea surface sensor readings, gyroscopic system readings, and individual stabilizer assembly positions into formulated data. The control computer then utilizes this formulated data to calculate the optimum location of the marine vessel and specific orientation of the stabilizer assemblies relative to sea surface conditions as a function of time. The control computer sends control data, based upon the formulated data, to the propulsion system and the stabilizer assemblies in order to position the marine vessel and individual stabilizer assemblies to their respective optimum positions, thereby effectively negating adverse sea surface conditions resulting in the overall stabilization of the marine vessel.

BRIEF DESCRIPTION OF THE DRAWINGS

The organization and manner of the structure and operation of the invention, together with further objects and advantages thereof, may best be understood by reference to the following description, taken in connection with accompanying drawings, wherein like reference numerals identify like elements in which:

FIG. 6 is a side elevational view of the stabilizer assembly illustrating the capability of the float arm to contract or expand, the float arm having a float arm axis, along with the capability of the float to rotate about the float arm axis;

FIG. 7 a cross-sectional view of the movable pivotal connection, connecting the support arms to the outrigger arm;

FIG. 8 is a fragmented, perspective view of the float arm with float attached thereto;

FIG. 9*a* is a top cross-sectional view of the float and float assembly, such float assembly being used to connect the float the float arm and to allow for limited movement of the float itself;

FIG. 9*b* is a forward cross-sectional view of the float and float assembly, along section line 9*b*—9*b* in FIG. 9*a*, such float assembly being used to connect the float to the float arm and to allow for limited movement of the float itself;

FIG. 9*c* is a side cross-sectional view of the float and float assembly, along section line 9*c*—9*c* in FIG. 9*a*, such float assembly being used to connect the float to the float arm and to allow for limited movement of the float itself;

FIG. 11 is a cross-sectional view of the alternate embodiment of the float, wherein the float size and shape is adjustable by expanding or contracting a plurality of telescoping arm in the float;

FIG. 12 is a cross-sectional view of the alternate embodiment of the float, showing the float in an alternate shape from that shown in FIG. 11;

FIG. 13 is a cross-sectional view of the float depicted in FIGS. 11 and 12, illustrating the capability of the bladder float to expand and contract, thereby altering its shape and buoyant force; and, FIG. 14 is a schematic flow chart of steps, along with a schematic of physical elements, utilized in the method of stabilizing a marine vessel floating upon, or moving across, a sea surface.

DETAILED DESCRIPTION OF THE PREFERRED EMBODIMENT

Figure 1:
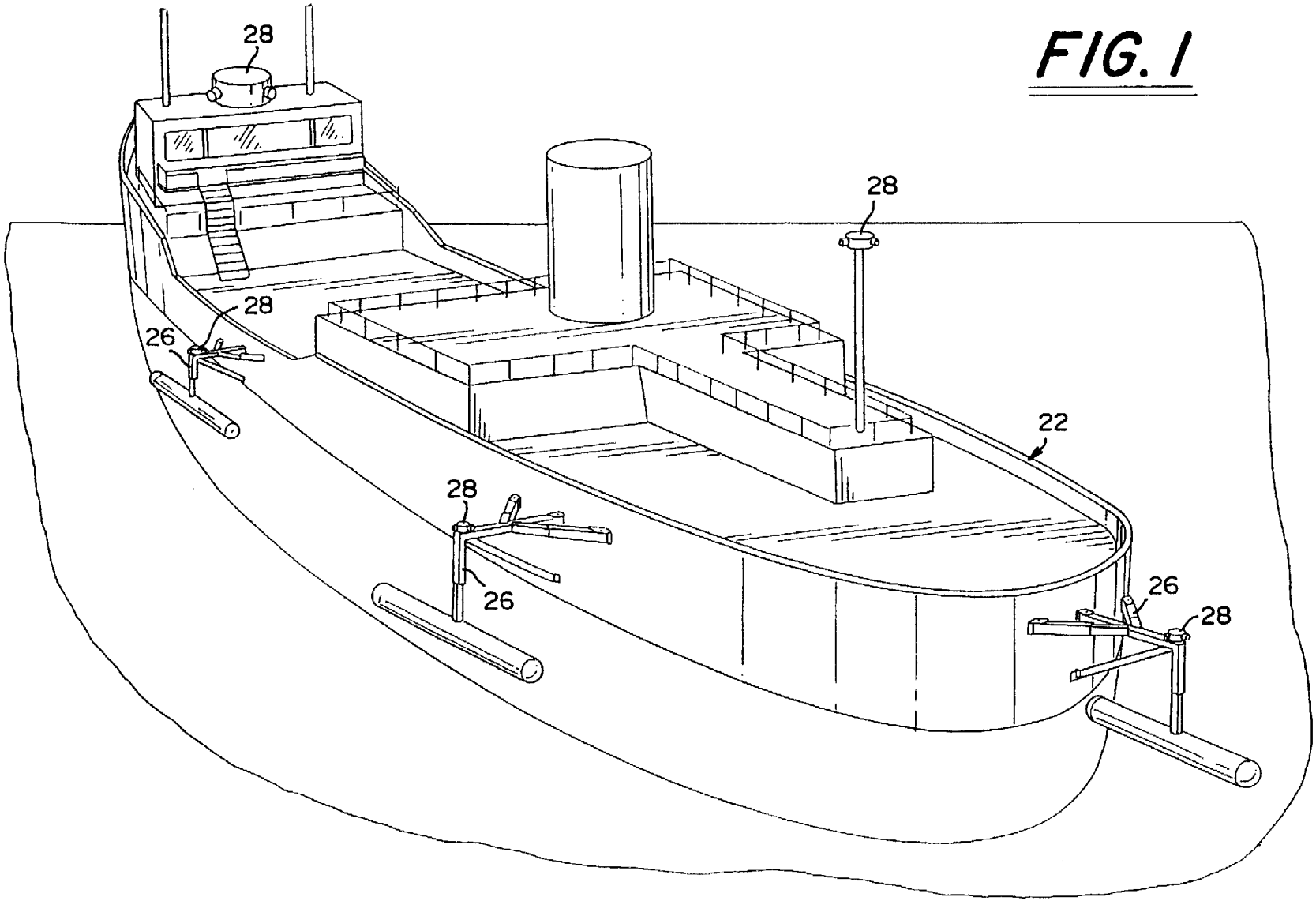
FIG. 1 is a perspective view of a novel stabilizer system having stabilizer assemblies for use with a marine vessel hull floating on a water surface in accordance with the invention, along with optional sensor positioning.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

The present invention is directed to a novel stabilizing system 20 for a marine vessel hull or a marine vessel 22 which is used to continuously stabilize the marine vessel 22 against impending adverse motion, such as an oncoming wave, as the marine vessel 22 is floating on or moving along a water or sea surface. The stabilizing system 20 is used in combination with the marine vessel's propulsion system 24 to optimally position the stabilizing system 20 and the marine vessel 22 as to effectively counteract the forces of oncoming wave motion. As used herein, marine vessel hull or marine vessel 22 can be defined as any floating, semi-submersible, or fully submersible (marine) structure suitable for use as such.

The stabilizing system 20 is comprised of at least one stabilizer assembly 26 which is fastened to the marine vessel hull 22, at least one condition sensor 28, a gyroscopic system 30, and a control computer 32 which may have artificial intelligence means therein, which are used in combination to continuously stabilize the marine vessel 22 as it is floating on or moving across the water or sea surface. The stabilizer assemblies 26 of the stabilizing system 20 are continuously positioned to optimal locations about the vessel 22 to effectively negate an impending wave motion, instead of merely correcting the vessel's response after an undesired wave motion.

Generally, the stabilizing assemblies 26, which have an individual position in relation to the marine vessel 22, suitably respond after the condition sensors 28 sense the ambient sea surface and atmospheric conditions relative to the marine vessel 22 as a function of time, producing condition sensor readings. Additionally, the gyroscopic system 30 accounts for differences in condition sensor orientation as the pitch, roll, and yaw of the marine vessel 22 changes with respect to time to produce gyroscopic readings. The control computer 32 interpolates and references the condition sensor readings against the gyroscopic readings, and combines sensor readings of individual stabilizer 26 positions together as a function of time into processed data. The control computer 32 constructs reaction data, based upon the processed data, which determines and corresponds to the optimal position of the marine vessel 22 and the individual stabilizer assemblies 26. These reaction data are transformed into a series of commands which positions the marine vessel 22, via the propulsion system 24, and the individual stabilizer assemblies 26 to their optimal positions to effectively negate adverse sea conditions.

The condition sensors 28 are mounted on the vessel 22 or on the individual stabilizer assemblies 26, or both, so as to have an unobstructed line of "sight" to the oncoming wave motions. If mounted on the vessel 22, the condition sensors 28 are preferably mounted as high as possible, height being an advantage to observe a larger area of the local sea surface, so local troughs are not hidden by wave crests. Each condition sensor 28, if mounted on the stabilizer assemblies 26, are preferably mounted on the outermost end of each assembly 26 to obtain the most accurate view of the sea surface. These views would help to improve depth perception of the individual condition sensors 28. The condition sensors 28 have the ability to sense ambient sea surface conditions, such as impending wave motions, sea surface height, and atmospheric conditions relative to the marine vessel 22, as a function of time in order to estimate wave velocity and changing wave profiles relative to the marine vessel 22. The condition sensors 28 must work well at night, in dense fog, or heavy rain conditions. Therefore, the condition sensors 28 may employ the use of any one or more of the following: infrared light beams and an infrared camera system, a radar system, or a sonar/echolocation system, either independently or together, in order to obtain accurate sea surface and atmospheric readings. It is also envisioned that video cameras could be used to visually sense and record ambient sea conditions. Also, binocular vision may be used for depth perception so distances between wave crests and troughs can be estimated.

The main control computer 32 and the gyroscopic system 30 are each located at a suitable site on the marine vessel 22, such as the bridge area, midships, or engine room of the vessel 22.

Figure 2:
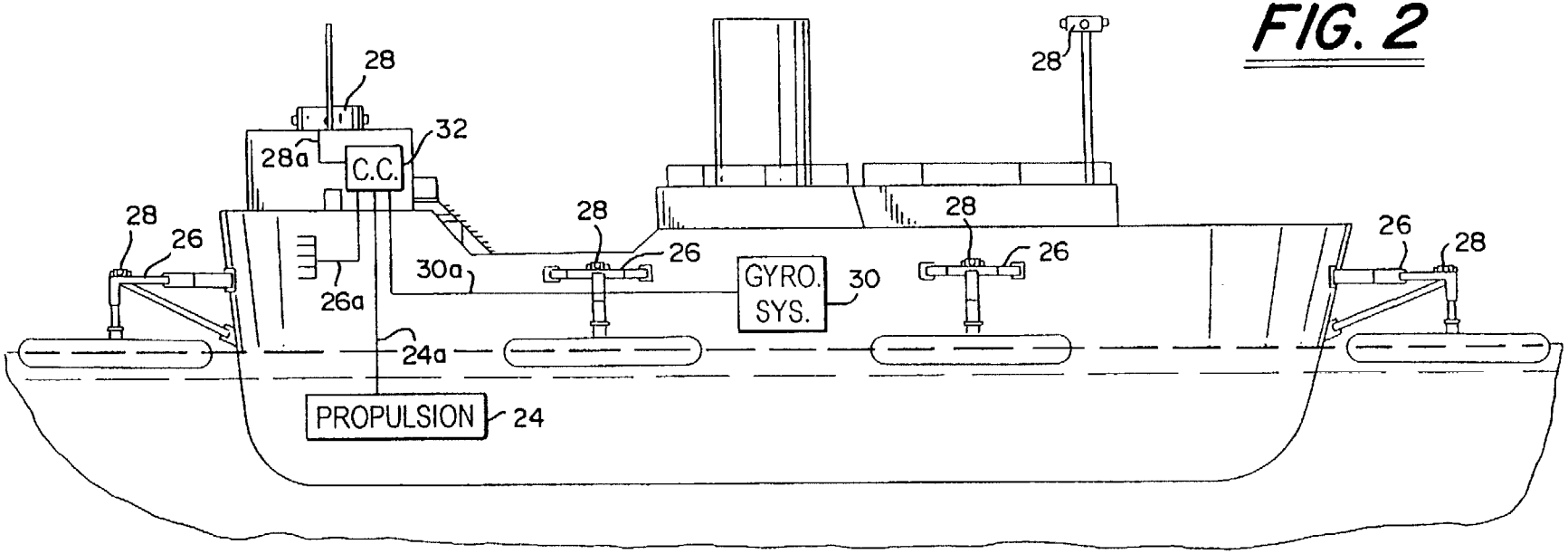
FIG. 2 is a side elevational view of the marine vessel and stabilizer assemblies shown in FIG. 1.

Directing attention to FIGS. 1 and 2, the marine vessel 22 is shown with a plurality of the stabilizer assemblies 26 attached thereto. The stabilizer assemblies 26 are positionable relative to the vessel 22, in a variety of positions, but are not limited to those shown in the drawings. Additionally, each stabilizer assembly 26 can be independently moved or manipulated with regard to the other stabilizer assemblies 26. A single stabilizer assembly 26 may be used or the stabilizer assemblies 26 may be used in pairs in order to achieve a desired effect on the marine vessel's stability.

Figure 3C:
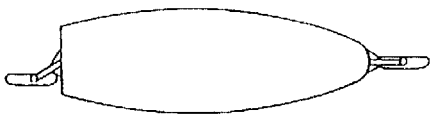
FIGS. 3*a*, 3*b*, and 3*c* are schematic top views of some of the available positioning configurations of the stabilizer assemblies relative to the marine vessel hull in accordance with the invention.
Figure 3B:
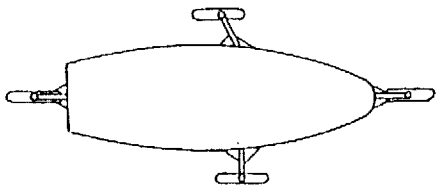
Figure 3A:
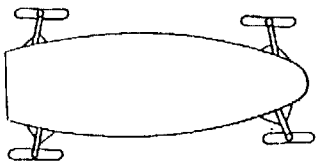

FIGS. 3*a*, 3*b*, and 3*c* are views of some of the available positioning configurations of the stabilizer assemblies 26 relative to the marine vessel 22. Although the stabilizer assemblies 26 preferably come in pairs, the individual positioning of the stabilizer assemblies 26 do not have to be located symmetrically about the marine vessel 22. For example, as shown in FIG. 3*a*, the stabilizer assemblies 26 may be mounted to the sides of the marine vessel hull 22; as shown in FIG. 3*b*, to the bow, stern and to the sides of the marine vessel hull 22; and as shown in FIG. 3*c*, to solely the bow and stern of the marine vessel hull 22. Alternatively, the stabilizer assemblies 26 may be mounted about the marine vessel hull 22 in any configuration desired, as to impart to the marine vessel 22 the desired overall trim and stability.

When the stabilizer assemblies 26 are positioned so that a stabilizer assembly 26 is forward of the bow and/or aft of the stern, the effective length of the vessel 22 is lengthened. It is to be understood that a single stabilizer assembly 26 may be provided forward of the bow or aft of the stern.

Figure 4:
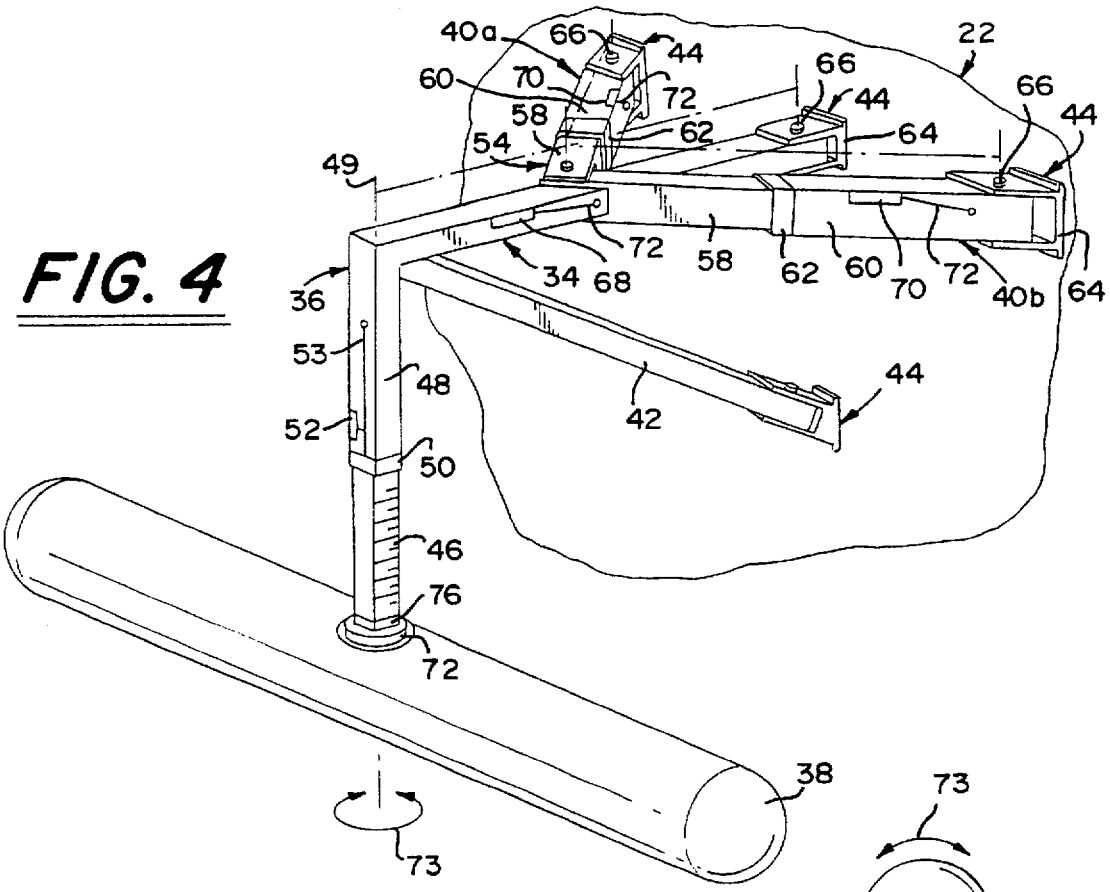
FIG. 4 is an perspective view of one of the stabilizer assemblies and the various components thereof, as shown in FIGS. 1 and 2, illustrating the individual components of the stabilizer assembly, those components generally comprising an outrigger arm, a telescoping float arm, at least one telescoping support arm, a reinforcing arm, a movable pivot connection, a plurality of mounting as assemblies, a float assembly, and a float.

Directing attention to FIG. 4, the specifics of one of the stabilizer assemblies 26 is illustrated. It is to be understood that while the specifics of one of the stabilizer assemblies 26 is described herein, the other stabilizer assemblies 26 used in the stabilizing system 20 are identical in configuration. Generally, the stabilizer assembly 26 of the present invention includes an outrigger arm 34, a telescoping float arm 36, a float 38, telescoping support arms 40*a* and 40*b*, and a reinforcing arm 42.

The outrigger arm 34 is typically of a fixed length and has one end which is attached to the marine hull 22 by a pivotal bracket assembly 44. The outrigger arm 34 generally extends laterally outwardly from the marine vessel hull 22 and the opposite end of the outrigger arm 34 is connected to the float arm 36. It is envisioned that the outrigger arm 34 may extend outwardly from the vessel hull 22 at an upward or downward angle.

The telescoping float arm 36 extends downwardly from the outrigger arm 34, and has a lower portion 46, an upper portion 48, and defines a central float arm axis 49. An upper end of the float arm upper portion 48 is attached to the end of the outrigger arm 34 at a junction. The upper portion 48 may be integrally formed with the outrigger arm 34 or may be a separate piece which is welded or otherwise affixed to the outrigger arm 34.

The lower portion 46 of the float arm 36 has the capability to expand and contract relative to the upper portion 48, in the direction of arrow 51 as shown in FIG. 6, and has the float 38 attached to the lower end of the lower portion 46. The float arm lower portion 46 is used to keep the float 38 in contact with the water or sea surface. Alternatively, the float arm lower portion 46 may be used to completely lift the float 38 out of its contact with the water to reduce drag. For example, in docking or calm seas, the floats 38 and the stabilizer assemblies 26 may be raised from the water's surface. The lower portion 46 of the float arm 36 is contracted and expanded with respect to the upper portion 48 by a suitable arm driving mechanism 50, such as hydraulic rams, pneumatic rams, gear assemblies, or electrical motors, but are not limited to such means in order to enact this motion.

Suitable position sensors 52 are provided to determine the relative positions of the lower and upper portions 46 and 48, respectively, of the float arm 36, the position sensors 52 also determining the position of the float 38. Suitable electronics and wiring 53 are provided for sending the position sensor readings back to the control computer 32. The electronics and wiring 53 also supply signals or commands, generated by the control computer 32, to the arm driving mechanism 50.

To move the lower portion 46 of the float arm 36, so that the float 38 moves upwardly and downwardly relative to the vessel hull 22 along the line defined by arrow 51, the following movements are enacted. When the float 38 is to be moved relative to the vessel 22, commands are sent by the control computer 32 to the arm driving mechanism 50 to move the lower portion 46 relative to the upper portion 48 of the float arm 36. Specifically, commands are sent to the arm driving mechanism 50 to suitably expand or contract the lower portion 46 relative to the upper portion 48 to effect the desired movement. For example, when the float 38 is to be moved downwardly relative to the vessel 22, the arm driving mechanism 50 causes the lower portion 46 of the float arm 36 to extend and effectively become longer to move the float 38 downward. When the float 38 is to be moved upwardly relative to the vessel 22, the arm driving mechanism 50 causes the lower portion 46 of the float arm 36 to contract and effectively become shorter to move the float 38 upward.

The telescoping support arms 40*a* and 40*b*, of the stabilizer assembly 26, each have one end which is connected at a movable pivotal connection 54, as shown in FIGS. 4 and 7, to the outrigger arm 34 and an opposite end connected to the marine vessel hull 22 by a pivotal bracket assembly 44. As shown in FIG. 7, an outboard end of each support arm, 40*a* and 40*b*, is connected to the outrigger arm 34 by a pin 56 which is engaged through an aligned aperture in each of the support arms 40*a* and 40*b* and the outrigger arm 34.

Figure 5:
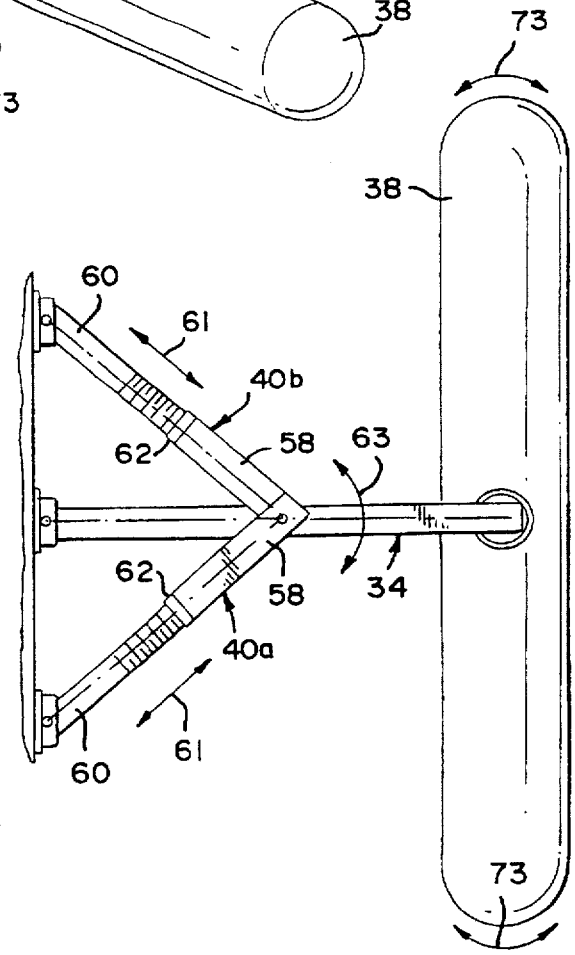
FIG. 5 is a top plan view of the stabilizer assembly, as shown in FIG. 4, illustrating the lateral motion capability of the stabilizer assembly, along with a view of the individual components of the stabilizer assembly with their respective motion capabilities.

Each support arm 40*a* and 40*b* is divided into an interior portion 58 and an exterior portion 60. The interior portion 58 is capable of being extended or contracted with respect to the exterior portion 60 along the line defined by arrows 61, as shown in FIG. 5, resulting in the movement of the entire stabilizer assembly 26 along the lateral plane defined by the outrigger arm 34 and as shown by arrow 63, as depicted in FIG. 5. The support arms 40*a* and 40*b* are contracted and expanded by suitable support driving mechanisms 62, as shown in FIGS. 4 and 5, such as hydraulic rams, pneumatic rams, gear assemblies, or electrical motors, but are not limited to such means in order to accomplish this motion of the stabilizer assembly 26.

The reinforcing arm 42 of the stabilizer assembly 26 is of a fixed length and is provided to lessen the load on and provide support for the outrigger arm 34. The reinforcing arm 42 has one end attached to the junction between the outrigger arm 34 and the float arm 36 and the opposite end attached to the marine hull 22 by a pivotal bracket assembly 44. The reinforcing arm 42 is typically angled relative to the outrigger arm 34 in order to provide proper support force. Another reinforcing arm (not shown) may be provided between the float arm 36 and the outrigger arm 34 and suitably connected thereto.

As shown in FIGS. 4–6, the details of the pivotal bracket assemblies 44 are illustrated. The pivotal bracket assemblies 44 retain the respective inboard ends of the outrigger arm 34, the support arms 40*a* and 40*b*, and the reinforcing arm 42 against the vessel hull 22. Each pivotal bracket assembly 44 includes a generally U-shaped bracket 64 and a retaining pin 66. The bracket 64 is affixed to the marine vessel hull 22 by suitable means, such as welding or magnets, which can support the weight and forces of the stabilizer assembly 26 while operating. Each respective inboard end of the outrigger arm 34, support arms 40*a* and 40*b*, and the reinforcing arm 42 of the stabilizer assembly 26 is retained within the channel of the U-shaped bracket 64 by an opening through the inboard end of the respective outrigger arm 34, support arms 40*a* and 40*b*, and the reinforcing arm 42, through which the respective retaining pins 66 are passed in order to secure the respective arms into the U-shaped bracket 64.

A suitable arm position sensor 68 is provided to determine the positions of the outrigger arm 34 and support arms 40*a* and 40*b*, relative to each other and to the vessel 22. Additionally, suitable support position sensors 70 are provided to determine the relative positions of the interior and exterior portions, 58 and 60, respectively, of the support arms 40*a* and 40*b*. Suitable electronics and wiring 72 are provided for sending the respective position sensor readings back to the control computer. The electronics and wiring 72 also supply signals or commands, generated by the control computer 32, to the support driving mechanisms 62.

To move the outrigger arm 34, support arms 40*a* and 40*b*, and the reinforcing arm 42 of the stabilizer assembly 26, so that the entire stabilizer assembly 26 moves along the lateral plane defined by arrow 63 in FIG. 5, the following sequence is enacted. When the stabilizer assembly 26 is to be moved, commands are sent by the control computer 32 to the various arm driving mechanisms to move the various arms. Specifically, commands are sent to the support driving mechanisms 62 to suitably expand or contract the support arms 40*a* and 40*b* to effect the desired movement. For example, when the stabilizer assembly 26 in FIG. 4 is moved to the right, moving the stabilizer assembly 26 laterally, the support driving mechanisms 62 cause the interior portion 58 of support arm 40*a* to extend and become longer and the interior portion 58 of support arm 40*b* to contract and become shorter. As the interior portion 58 of arm 40*a* becomes longer, this causes the outrigger arm 34, reinforcing arm 42, and support arms 40*a* and 40*b* to pivot relative to the vessel 22 via pivotal connections 44, moving the stabilizer assembly 26 along the lateral plane 63. When the stabilizer assembly 26 in FIG. 4 is moved to the left, moving the stabilizer assembly 26 laterally, the support driving mechanisms 62 causes the interior portion 58 of support arm 40*b* to extend and become longer and the interior portion 58 of support arm 40*a* to contract and become shorter. As the interior portion 58 of arm 40*b* becomes longer, this causes the outrigger arm 34, reinforcing arm 42, and support arms 40*a* and 40*b* to pivot relative to the vessel 22 via pivotal connections 44, moving the stabilizer assembly 26 along the lateral plane 63 of FIG. 5.

Attention is now directed to FIGS. 8 and 9, which shows the details of the interconnection between the float 38 and the float arm 36. The interconnection shown in FIGS. 8 and 9 is merely illustrative and other suitable interconnections may be used.

Affixed to the lower portion 46 of the float arm 36 is a rotator plate 72. The rotator plate 72 allows the float 38 to be rotated about the float arm central axis 49, in the direction of arrow 73 shown in FIG. 8. The rotator plate 72 can be formed of two plates which can be rotated with respect to one another, similar to such ball bearing supported movable plates that are known within the industry. The rotator plate 72, which moves a float assembly 74 operatively connected to the float 38, as shown in FIGS. 9*a*, 9*b*, and 9*c*, is rotated about the central float arm axis 49 by a rotational driving mechanism 76, such as a motor or gear assemblies, or the like, located within the float arm 36. The rotational driving mechanism 76 is controlled by a command or signal from the control computer 32. Suitable electronics and wiring 75 are provided for sending the respective rotational driving mechanism 76 position back to the control computer. The electronics and wiring 75 also supply signals or commands, generated by the control computer 32, to the rotational driving mechanism 76.

The float 38 is operatively connected to the rotator plate 72 by the float assembly 74. Specifically, the float assembly 74 is comprised of a spherical joint 78 with an engaging rod 80 extending from the spherical joint 78, with the engaging rod 80 operatively connected to a float hub 82 located within the float 38 to provide for the attachment of the float assembly 74 to the float 38. The float assembly 74 allows for limited, multi-directional motion (X, Y, and Z) of the float 38, with respect to the lower portion 46, and thus to the marine vessel 22. The limited motion of the float 38 allowed by the float assembly 74 effectively changes the applied cross-sectional shape and buoyant force of the float 38, as part of the float 38 becomes partially submerged due to the restricted motion of the float 38 with respect to the acting wave motions.

Specifically, the float 38 may move simultaneously in the pitch, roll, or yaw directions through the float assembly 74. FIGS. 9*a*, 9*b*, and 9*c* illustrate in detail the elements comprising the float assembly 74. The float assembly 74 is comprised of the spherical joint 78, the spherical joint 78 being retained by a semi-spherical cavity 84 located within the actual body of the float 38. The spherical joint 78 has an upper and lower end, the upper end being operatively connected to the rotator plates 72. The rotator plates 72, in response to a signal or command from the control computer 32, allow the float 38 to be rotated about the float arm central axis 49, in the direction of arrow 73, which corresponds to the yaw direction.

The lower end of the spherical joint 78 has the engaging rod 80 extending downwardly and away from the lower end of the spherical joint 78. The engaging rod 80 is received within an aperture centered in the float hub 82, with the engaging rod 80 operatively connected to the float hub 82. The float hub 82 is itself located and retained in a stationary position relative to the spherical joint 78, the float 38 actually being the component that is manipulated or moved.

The float 38 has a hollow interior portion containing a set of respective drive tracks which allow the float 38 to be moved in either the roll or pitch directions. A first drive track 88, as shown in FIG. 9*b*, extends a predetermined length along a first semi-arc pathway as defined by a roll plane 89. While, in FIG. 9*c*, a second drive track 90 extends a predetermined length along a second semi-arc pathway as defined by a pitch plane 91.

Accordingly, the float hub 82 has an upper and a lower surface, the lower surface of the float hub 82 retains a first set of float driving mechanisms 92 operatively connected to the float hub 82. The first float driving mechanisms 92 are used for moving the float 38 toward a port or starboard roll direction along the roll plane 89, as the float hub 82 is retained in a stationary position relative to the spherical joint 78. Further, the first float driving mechanisms 92 may be any device such as gearing, pneumatics, or electrical devices, but not limited to these, for actuating and accomplishing the desired movements of the float 38. Additionally, the first float driving mechanisms 92 contain suitable connections 94 thereto in order to provide for a source of power, along with respective communication for providing signals or commands from the control computer 32 to the first float driving mechanisms 92.

Initially, a signal or command is received by the first float driving mechanisms 92 from the control computer 32 in order to effect a specified movement of the float 38 along the roll plane 89. The command or signal then causes the first float driving mechanisms 92 to engage the first drive track 88 located along the first semi-arc pathway. The first drive track 88 extending a predetermined length along the first semi-arc pathway as defined by the roll plane 89. The first float driving mechanism 92 then engages the first drive track 88 when the first float driving mechanisms 92 are activated, moving the float 38 along the first drive track 88 in a direction defined by the roll plane 89, as the float hub 82 is retained in a stationary position relative to the spherical joint 78. The first float driving mechanism 92 causes the movement of the float 38 along the roll plane 89, the float 38 being capable of being rolled or moved in either the port or starboard directions.

In order to effect motion of the float 38 along the pitch plane 91, a second set of float driving mechanisms 96 are operatively and fixedly attached to the each of the outermost ends of the first drive track 88. The second float driving mechanisms 96 are utilized for moving the float 38 toward a fore or aft pitch direction along the pitch plane 91, as the float hub 82 is retained in a stationary position relative to the spherical joint 78. Further, the second float driving mechanisms 96 may be any device such as gearing, pneumatics, or electrical devices, but not limited to these, for actuating and accomplishing the desired movements of the float 38. Additionally, the second float driving mechanisms 96 contain suitable connections 98 thereto in order to provide for a source of power, along with respective communication for providing signals or commands from the control computer 32 to the second float driving mechanisms 96.

Initially, a signal or command is received by the second float driving mechanisms 96 from the control computer 32 in order to effect a specified movement of the float 38 along the pitch plane 91. The command or signal then causes the second float driving mechanisms 96 to engage a second drive track 90 located along the second semi-arc pathway, the second drive track 90 extending a predetermined length along the second semi-arc pathway as defined by the pitch plane 91. The second float driving mechanism 96 then engages the second drive track 90, the second drive track 90 located along and rigidly and fixedly attached to a lower interior surface of the float 38. The second float driving means 96 then moves the float 38 along the pitch plane 91, as the float hub 82 is retained in a stationary position relative to the spherical joint 78. The second float driving mechanism 96 causes the movement of the float 38 along the pitch plane 91, the float 38 being capable of being rolled or moved in either the forward or aft direction.

The float 38 may move simultaneously in the pitch, roll, or yaw directions through the float assembly 74. For example, if a command given by the control computer 32 required the float 38 to be moved in pitch, roll, and yaw directions simultaneously, the float 36 being initially located in an arbitrary neutral position [(0x)-roll, (0y)-pitch, (0z)-yaw), the following sequence would occur. The rotator plates 72 would rotate the float 38 along the z-yaw axis from the initial position (0z) on the z-yaw axis to second position (Az), as determined by the parameters of the command. While the rotator plates 72 are moving the float 38, the first float driving mechanisms 92 engage the first drive track 88 to move the float 38 along the x-roll axis from an initial position (0x) on the x-roll axis to second position (Ax), again as determined by the parameters of the command. Simultaneously, as the float 38 is being moved about the z-yaw axis and the x-roll axis, the second float driving mechanisms 96 engage the second drive track 90 moving the float 38 along the y-pitch axis from an initial position (0y) on the y-pitch axis to second position (Ay), as determined by the parameters of the command. As illustrated, the float 38 is capable of being moved in the pitch, roll, and yaw directions simultaneously, based on the parameters of the command given to the respective mechanisms by the control computer 32.

Figure 10A:
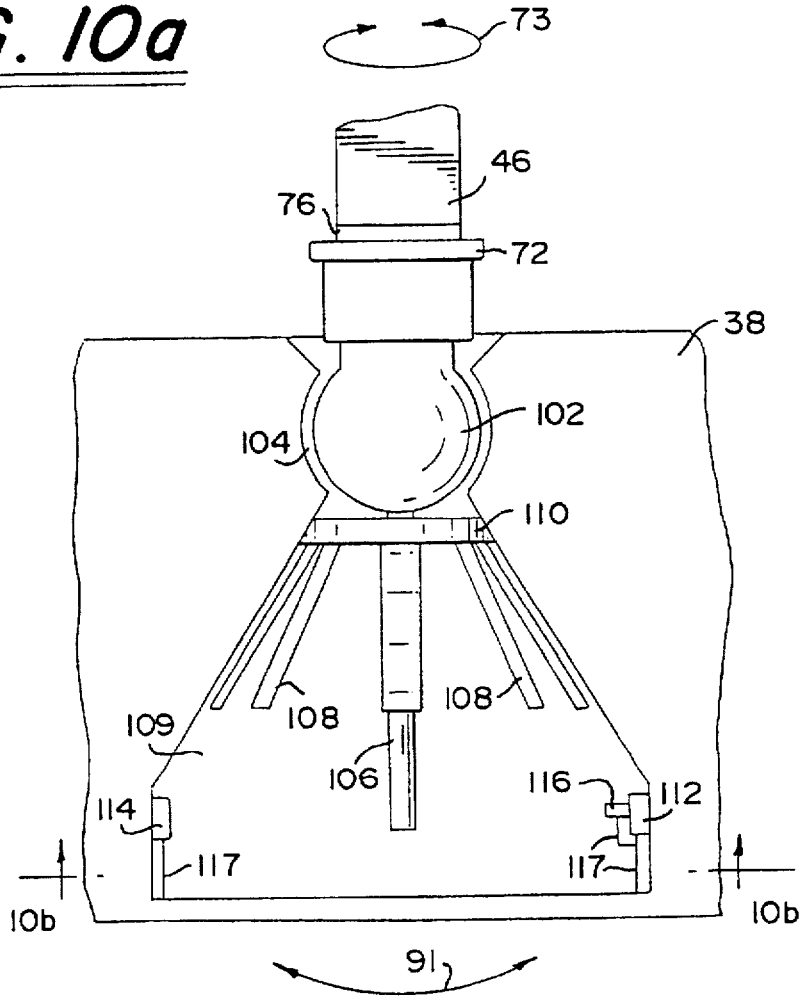
FIG. 10*a* is a side cross-sectional view of an alternate embodiment of the float assembly, such float assembly being used to connect the float to the float arm and to allow for limited movement of the float itself.
Figure 10B:
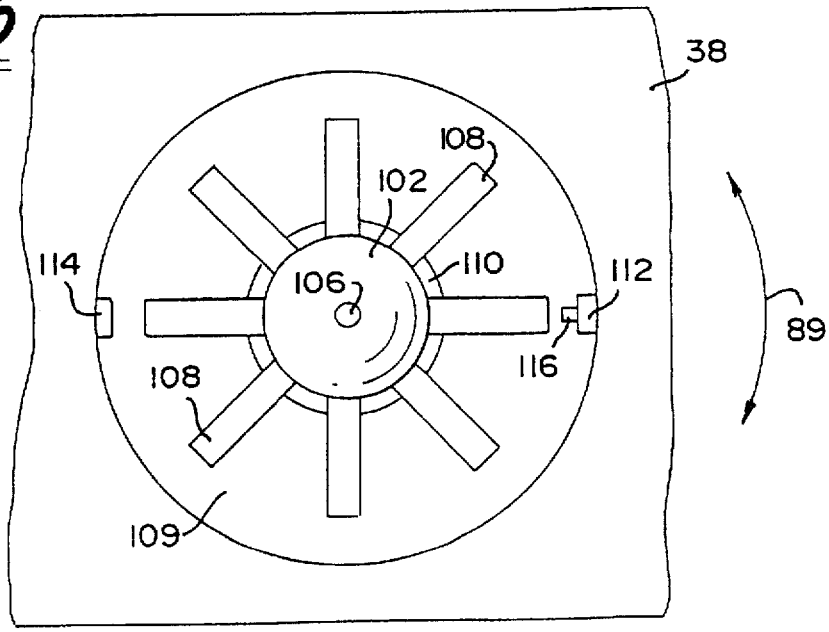
FIG. 10*b* is a cross-sectional view of an alternate embodiment of the float assembly, along section line 10*b*—10*b* in FIG. 10*a*, such float assembly being used to connect the float to the float arm and to allow for limited movement/of the float itself.

An alternate embodiment of the float assembly 74, as depicted in FIGS. 10*a* and 10*b*, may be utilized with the stabilizer assembly 26. Similar to the first float assembly 74 embodiment, the alternate float assembly 100 is comprised of a spherical joint 102, the spherical joint 102 being retained by a semi-spherical cavity 104 located within the actual body of the float 38. Again, the spherical joint 102 has an upper and lower end, wherein the upper end is rigidly connected to the rotator plates 72. Similarly, the rotator plates 72, in response to a signal or command from the control computer 32, allow the float 38 to be rotated about the float arm central axis 49, in the direction of arrow 73, which corresponds to the yaw direction.

In the alternate float assembly 100, however, the lower end of the spherical joint 102 has a magnetizable positioning rod 106 extending downwardly and away from the lower end of the spherical joint 102 extending into a hollow interior portion 109 within the float 38. Within the hollow interior portion 109 there are a series of electromagnets 108 which are operatively and rigidly connected to a ring 110, the ring 110 being operatively and rigidly connected to an interior wall portion of the float 38. The series of electromagnets 108 are arranged in a generally circular pattern, but any pattern may be used to effect a desired magnetic reaction. The magnetizable positioning rod 106 is extended into the center of the center of the pattern of electromagnets 108, wherein the electromagnets 108 are positioned about the magnetizable positioning rod 106. Each electromagnet 108 of the series of electromagnets 108 has the ability to exert a magnetic force, when energized, upon the magnetizable positioning rod 106. The magnetic force being of a magnitude as to allow each individual electromagnet 108 to be attracted to the magnetizable positioning rod 106, when energized.

Upon energizing different electromagnets 108, the energized electromagnets 108 will exert a magnetic force and be drawn toward the magnetizable positioning rod 106. The float 38, having the energized electromagnets 108 affixed to the ring 110 which is rigidly and operatively connected to the float 38, will move toward the magnetizable positioning rod 106 about the spherical joint 102, thereby moving the float 38 itself as the magnetizable positioning rod 106 remains stationary Each electromagnet 108 is electrically coupled to a local microprocessor 112 which supplies an energizing signal to each electromagnet 108. The energizing signal allows for the electrical coupling of an external power source (not shown) to the individual electromagnet 108 which is to be energized, in order to create the electromagnetic force of each electromagnet 108 to be exerted upon the magnetizable positioning rod 106.

Initially, the control computer 32 sends a signal or command to the local microprocessor 112 through suitable electronics and wiring 117, the electronics and wiring 117 being provided for sending and transmitting commands and signals to and from the control computer 32. The signal or command may be in the form of a binary encoded bit string, wherein each bit of the bit string corresponds to specific electromagnet 108 which is to be energized. The local microprocessor 112 converts the binary encoded bit string into a series of electrical pulses, each electrical pulse corresponding to an individual electromagnet 108 contained within the series of electromagnets 108. The respective pulses are directed to the respective electromagnets 108 which allows the respective electromagnets 108 to be energized. The energized electromagnets 108, which are rigidly affixed to the interior of the float 38 through the ring 110, move the float 36 toward the rigidly positioned magnetizable positioning rod 106 through the force of the acting electromagnetic force of each electromagnet 108 on the magnetizable positioning rod 106.

Additionally, a local gyroscope 114 may be affixed to the float 38 to allow the local processor 112 finer control of the orientation of the float 38. The local gyroscope 114 can be utilized as a base reference of the initial orientation of the float 38, wherein the local microprocessor 112 can utilize readings from the local gyroscope 114 as the actual real time orientation of the float 38. The gyroscopic information from the local gyroscope 114 allow the local microprocessor 112 to continuously re-orient the float 38 at the desired position as wave forces act upon the float 38, by comparing with the original signal or command from the control computer 32 with the present gyroscopic information.

Similarly, the float 38 may move simultaneously in the pitch, roll, or yaw directions through the float assembly 100. For example, if a command by the control computer 32 required the float 38 to be moved in pitch, roll, and yaw directions simultaneously, the float 38 being initially located in an arbitrary neutral position (0x-roll, 0y-pitch, 0z-yaw), the following sequence would occur. The rotator plates 72 would rotate the float 38 along the z-yaw axis from an initial position (0z) on the z-yaw axis to second position (Az), as determined by the parameters of the command. While the rotator plates 72 are moving the float 38, individual electromagnets 108 are energized through the local microprocessor 112, based upon a signal or command from the control computer 32. The respective energized electromagnets 108 are then pulled toward the magnetizable positioning rod 106 by the acting electromagnetic force. This acting electromagnetic force moves the float 38 along the x-roll axis 89 from an initial position (0x) on the x-roll axis 89 to second position (Ax), while simultaneously moving the float along the y-pitch axis 91 from an initial position (0y) on the y-pitch axis 91 to second position (Ay), as determined by the parameters of the command. As illustrated, the float 38 can be moved in the pitch, roll, and yaw directions simultaneously, based upon the parameters of the signal or command given to the local microprocessor 112 by the control computer 32.

The floats 38 used on each stabilizer assembly 26 are lightweight and shaped to minimize drag and resistance to the sea surface. The combined volume of the floats 38 preferably displaces approximately ten percent of the vessel's total displacement. With this embodiment of the stabilizer assembly 26, each float 38 is a pre-formed solid shape and is made of a suitable material, such as a watertight, plastic material.

Suitable float position sensors 116 are provided to determine the position of the float 38 relative to the float arm 36 and to the vessel 22. Suitable electronics and wiring 117 are provided for sending the position sensor readings back to the control computer 32.

In response to a command given by the control computer 32 in response to impending wave motion, the stabilizer assemblies 26 themselves may be moved independently with respect to each other. Each stabilizer assembly 26 allows for the motion of various components comprising the stabilizer assembly 26 to move independently from the motion of the stabilizer assembly 26 itself, such as the lower portion 46, support arms 40*a* and 40*b* (each support arm being dependent on the other), and the float 38 through the float assembly 74 and rotator plates 72. The allowance of the individual stabilizer assemblies 26 to move independently of each other, along with the allowance of the individual components of the stabilizer assemblies 26 to move independently of each other, gives the stabilizer assemblies 26 a wide range of possible concurrent motion to effectively negate the effect of an impending wave motion.

Specifically, each stabilizer assembly 26 can be moved along the lateral plane 63 defined by the outrigger arm 34, by the respective contraction or expansion of support arms 40*a* and 40*b*, resulting in the movement of the entire stabilizer assembly 26 to a desired position dictated by the control computer 32. In addition, the lower portion 46 of the float arm 36 is simultaneously capable of expanding and contracting with respect to the upper portion 48 of the float arm 36 resulting in the movement of the float 38 along the central float arm axis 49. This up and down movement of the float 38 can be translated into a reduction of the vertical motion of the vessel hull 22 in the water. As the lower portion 46 is in motion relative to the upper portion 48, the float 38, by use of the rotator plate 72, is allowed to independently rotate about the central float arm axis 49. As the float 38 is rotating about the central float arm axis 49, the float assembly 74 allows independent limited multi-directional motion of the float 38 with respect the float arm 36. The limited motion allowed by the float assembly 74, which in turn limits the motion of the float 38, effectively changes the applied cross-sectional shape and buoyant force of the float 38, as part of the float 38 becomes partially submerged due to the restricted motion of the float 38 with respect to the acting wave motions.

Alternatively, as shown in FIGS. 11–13, the float 38 may be constructed of a flexible bladder 118, made of synthetic rubber or other watertight flexible material, placed over a plurality of telescoping arms 120. The telescoping arms 120 are capable of being expanded or contracted to change the effective cross-sectional shape of the float 38 itself.

As shown in FIGS. 11–13, the telescoping arms 120 are capable of being independently expanded or contracted relative to a plurality of float hubs 122. The float hubs 122 are located at opposite ends of a float hub arm 124. The float hub arm 124 is connected by a central hub 126 to a float assembly 128, the float assembly 128 being operatively connected to the rotator plates 72. Within the float hub arm 124 are channels (not shown) which allow for the transmission of power through the float hub arm 124, either hydraulic, pneumatic, gearing, or electric, but not limited to those power sources, to the individual float hubs 122. The power channeled through the float hub arm 124 is used to contract and expand the telescoping arms 120 with respect to the respective float hub 122.

The telescoping arms 120 are capable of expanding or contracting against the bladder 118 to effectively change the applied cross-sectional shape of the float 38. The result of the expanding or contracting the telescoping arms 120, which would increase or decrease the applied cross-sectional shape of the float 38, corresponds to an increase or decrease of the buoyant force of the float 38. Therefore, when the bladder 118 is increased or decreased in size, the buoyant force is respectively increased or decreased in proportion to the applied cross-sectional shape of the float 38. The increased or decreased buoyant force is then transmitted through the stabilizer assembly 26, resulting in a respectively corresponding increased or decreased overall stability of the marine vessel 22.

Now that the specifics of the stabilizer system 20 have been described, the method for using the stabilizer system 20 is set forth, as detailed below and in FIG. 14. The method predicts the vessel's response to impending adverse motion, such as an oncoming wave, and enacts the respective stabilizer assemblies 26 in the stabilizing system 20 to effectively negate the effective force of the impending adverse motion, instead of merely correcting the vessel's response after the undesired adverse wave motion. In addition to the stabilizing system 20, the vessel's propulsion system 24 may be used to optimally position the vessel 22 in response to an impending adverse wave motion.

STEP 1: Sense Ambient Sea Surface Conditions

In order to assist in the estimations of wave velocity and changing wave profiles relative to the marine vessel 22, condition sensors 28 sense the ambient sea surface conditions, such as impending wave motions, sea surface height and distance, and atmospheric conditions relative to the marine vessel 22 as a function of time, producing condition sensor readings. The condition sensor readings are transmitted to the control computer 32 through suitable electronics and wiring 28*a*. These condition readings are referenced to an standard internal clock contained within the control computer 32 in order to establish and assign an initial condition sensor reading time. The condition sensors 28 provide at least two views of the sea surface relative to the vessel 22 as a function of time. The first view is of the relative depth of a wave trough and the relative height of a wave crest; while the second view is of the distance of the vessel 22 relative to the waves. These two views may be accomplished by the condition sensors 28 through the use of a standard triangulation process in conjunction with binocular vision.

STEP 2: Reference Condition Sensor Readings Against Vessel's Gyroscopic System

Next, the condition sensor readings are referenced, by the control computer 32, against vessel gyroscopic readings (orientation information) provided by the vessel's gyroscopic system 30 to account for differences in the condition sensor 28 orientation as the pitch, roll, and yaw of the vessel 22 changes with respect to time. The gyroscopic readings are transmitted to the control computer 32 through suitable electronics and wiring 30*a*. The gyroscopic readings allow for accurate condition sensor readings, as the gyroscopic system 30 provides a proper horizontal and vertical plane reference for the condition sensors 28. The condition sensor readings may be referenced against the vessel's gyroscopic system 30 at the next available computer cycle within the control computer 32, or it may be done at the same time the condition sensor reading are taken by the use of parallel processing within the control computer 32. The computer cycles of the control computer 32 may be set by the operator at any timing sequence in order to match the relative needs of the vessel 22 in relation to ambient sea surface conditions.

Step 3: Generate Sea Surface Model And Estimate Wave Velocities Relative To The Vessel These referenced condition sensor readings are then loaded into the control computer 32, where the sea surface conditions, such as wave velocities, heights, and distances relative to the vessel 22 are estimated. Such sea surface condition estimations may be accomplished through the use of standardized mathematical function fitting computer programs, wherein the mathematical function fitting computer programs may further be represented in a graphical map display form. The standardized mathematical function fitting computer programs are capable of plotting deviant data information accumulated from an external source against a base representation of an empirical model, as a function of time, thereby creating a model of real time data information. Utilizing such standardized mathematical function fitting computer programs, the condition sensor readings(deviant data) are converted into physical condition data and plotted on a computer generated graphical representation of a base model of normal sea surface conditions (empirical model), as a function of time, creating a primary sea surface model of actual (real time) sea surface conditions.

Further, the primary sea surface model of actual (real time) sea surface conditions may be compared to previous (past) primary sea surface models by the control computer 32 at desired timing cycles to produce an accurate average wave velocity and distance relative to the marine vessel 22. The primary sea surface model comparison, for example, may be conducted approximately a few times per second to once every couple of seconds in order to estimate and update the average wave velocity and distance relative to the marine vessel 22 over time. Again, the computer cycles of the control computer 32 may be set by the operator at any timing sequence in order to match the relative needs of the vessel 22 in relation to ambient sea surface conditions.

STEP 4: Sense Stabilizer Positions

After the condition sensor readings have been plotted to create a primary sea surface model, a series of position sensors sense the positions of the individual stabilizer assembly or assemblies 26 and individual stabilizer components relative to the vessel 22, the respective positions of the individual stabilizer assembly or assemblies 26 and stabilizer components transmitted from the respective electronics and wiring may be transmitted to a stabilizer interface unit 26*a* through a common line 26*b*. This series of position sensors comprising, for example, position sensors 52 which determine the relative positions of the lower and upper portions 46 and 48, respectively, of the float arm 36, position sensor 52 also sensing the position of the float 38; support position sensors 70 which determine the relative positions of the interior and exterior portions, 58 and 60, respectively, of the support arms 40*a* and 40*b*; position sensor 68 which determines the positions of the outrigger arm 34 and support arms 40*a* and 40*b*, relative to each other and to the vessel 22; and float position sensors 116 which determine the position of the float 38 relative to the float arm 36 and to the vessel 22. These respective position sensor readings are then transmitted and loaded into the control computer 32 from the stabilizer interface unit 26*a* via interface line 26*c*.

STEP 5: Inputting And Interpolating Data With The Control Computer

The referenced condition sensor readings are processed together, along with the stabilizer assembly position readings, as a function of time and are converted into processed data by, for example, an analog to digital converter. The processed data may comprise a binary encoded bit string, wherein each bit of the bit string represents a particular condition associated with either the position of the stabilizer assemblies 26 and stabilizer components or the data accumulated by the condition sensors 28. The processed data, which includes referenced condition sensor readings (i.e. -referenced against gyroscopic system readings), and individual stabilizer assembly position readings, is then analyzed and interpolated in the main control computer 32. The processed data interpolated in the control computer 32 is then plotted as a function of time against a graphical representation of the primary sea surface model, in order to create a mathematical processed sea surface model according to the processed data.

STEP 6: Analysis Of Processed Data By Control Computer To Calculate Forces Acting Upon Vessel As previously mentioned in relation to STEP 3, the lateral, vertical, and angular velocities of the vessel 22 relative to the waves can be estimated via the control computer 32 from the condition sensors 28 recording of the positions of wave crests as a function of time against the position of the vessel 22, giving the equivalent lateral, vertical, and angular velocities of the vessel 22. From this information, the average linear momentum of the vessel 22 relative to the sea surface may be determined using computer programs contained in the control computer 32 which execute standard physics/mathematical formulation programs to generate momentum data.

From the sea surface height and distance relative to the vessel 22, the forces and torques acting of the vessel 22 due to the uneven sea surface can also be continuously estimated, by using the constant flow of processed data and loading the processed data into standard physics/mathematical formulations programs located within the control computer 32. The control computer 32 may utilize the mathematical processed sea surface model according to the processed data in the standard physics/mathematical formulations programs to determine the forces and torques acting on the vessel 22, as the waves are graphically represented against the vessel 22 as a function of time. The calculation of the velocity, momentum, and torques acting upon the vessel 22 are calculated at the next desired computer cycle of the control computer 32 after the processed data have been received by control computer 32.

For the purposes of the physics/mathematical calculations, the vessel 22 may be subdivided into several sections, both fore to aft, and port to starboard. Accordingly, each section of the vessel 22 will have a specific height and orientation with respect to the sea surface, wherein the control computer 32 may further compute the displacement for each section based upon the mathematical processed sea surface model according to the processed data. The control computer 32 will then be able to, using physics/mathematical formulations programs based upon the vessel's construction and pre-determined operating characteristics and parameters, calculate the difference between the upward forces on the vessel's several sections due to the displacement of the waves and the downward vertical force due to the vessel's weight for each section. By determining the effective force acting on each of the several sections of the vessel 22, along with the forces acting upon each of the floats 38, a net force acting upon the vessel 22 can be produced. The net torque acting upon the vessel 22 may be determined by utilizing the respective forces acting upon each section of the vessel and multiplying the respective force by the respective lever arm extending from the respective center of gravity for each section of the vessel 22. By calculating the respective torques acting upon the vessel 22, the overall net torque acting upon the vessel 22 about a common center of gravity in the respective roll, pitch, and yaw directions can be accurately determined.

STEP 7: Vessel Behavior Prediction Calculations

The laws of physics are used to predict the vessel's behavior from the preceding information (linear and angular momenta, forces and torques) in the control computer 32. Initially, estimates of the vessel's mass and moments of inertia may be fed to, or stored in, the control computer 32 from a base value according to the vessel's original operating parameters. The predicted values, however, are determined essentially by using the vessel's current linear and angular velocities, linear and angular momenta, and torques acting upon the vessel 22 in order to create a real time mathematical algorithm of how the vessel 22 is responding to the current sea surface conditions. This real time mathematical algorithm can be constructed from an original mathematical behavior algorithm that is typically created at the time the vessel is tested in laboratory model testing tanks. Alternately, the real time mathematical algorithm may be created any time the vessel 22 may go on sea trial exercises, by recording the performance data of the vessel 22 on sea trial. This mathematical algorithm is then applied against the mathematical representation of the processed sea surface model.

Accordingly, a standard physics/mathematical applications program predicts values relating to the vessel's behavior as a function of time along the mathematical representation of the processed sea surface model. The physics/mathematical applications program generates a series of behavior response values relating to individual positions along the processed sea surface model, which is typically done by applying the mathematical algorithm along a mathematical integral defined and generated by the processed sea surface model. The applications program utilizes the vessel's base mass and moments of inertia to, according to the determined mathematical algorithm of the vessel's predicted reaction, establish how the vessel 22 will respond as it travels along the mathematical representation of the processed sea surface model.

The control computer 32 then loads the data (behavior response values) generated by the physics/mathematical applications program into a compilation program. The compilation program, containing physics/mathematical formulations, processes the behavior response values in order to generate reaction data. The reaction data is the targeted optimal position of the stabilizer assemblies 26 and vessel 22 position necessary to maintain the vessel's orientation along a horizontal plane along the mathematical representation of the processed sea surface model, which represents impending wave forces to act upon the vessel 22. The reaction values may then be stored into a memory contained within the control computer 32.

Revised values of reaction data may be obtained from a comparison of predicted and observed behavior of the vessel 22 and updated into the memory of the control computer 32. The reaction data values may be loaded into a comparison data table against real time behavior data of the vessel 22 from incoming sensor data. As incoming real time sensor data have not yet been processed, the comparison data table allows for the reaction data values to be continuously compared to the real time sensor values. Such a comparison of reaction data values against real time sensor values allows for the use of parallel processing of the reaction data values, wherein the reaction data values can be confirmed against the real time sensor values to confirm or alter the reaction data values. Importantly, the buoyant force actions of the floats 38 are also included in the predictions as they essentially provide for the negation of the wave forces acting upon the vessel.

STEP 8: Positioning of Stabilizer Assemblies and Vessel

The control computer 32 having generated reaction data, as illustrated in STEP 7, further generates position data based upon the reaction data. The position data generated by the control computer 32 is essentially accomplished, for example, by the use of a standard digital to analog converter which converts the reaction data into a series of signals or commands. These signals or commands are sent to both the stabilizer assemblies 26 and the vessel's propulsion system 24. The commands or signals are transmitted from the control computer 32 to the vessel's propulsion system 24 through suitable electronics and wiring **24*a*. While, additional commands or signals are transmitted from the control computer 32 to the stabilizer assemblies 26 through the stabilizer interface unit 26*a*. The signals or commands enable the vessel 22 to be positioned, along with the individual stabilizer assembly or assemblies 26, in the optimum positions in order to effectively negate the effect of an impending wave motion. When the vessel's propulsion system 24 is employed to move the orientation of the vessel 22 itself, the control computer 32 sends signals or commands to the propulsion system 24, such as the engine room of a vessel 22, which in turn activates the appropriate propulsion and steering mechanisms of the vessel 22**.

Repeating STEP 1 through STEP 8 at predetermined or desired intervals provide for the continuous stabilization of the marine vessel 22. The physical timing of the individual steps involved in the stabilization method is not of dire consequence, but rather, may be altered to fit the actual ambient environment. Again, the computer cycles of the control computer 32 may be set by the operator at any timing sequence in order to match the relative needs of the vessel 22 in relation to ambient sea surface conditions.

An example of the novel prediction process is as follows and is described with respect to the vessel 22 heading straight into the waves and only having fore and aft stabilizer assemblies 26. When the vessel 22 is heading into a trough, there will be a torque acting on the vessel 22 because the buoyancy will be less at the bow than the stern. The torque will induce the vessel's pitch to change. The control computer 32 predicts this change and signals the forward stabilizer assembly 26 to go down, reducing the torque acting on the forward end of the vessel 22. Likewise, when the vessel 22 is heading out of a trough, the aft stabilizing assembly 26 is lowered by a signal from the control computer 32 to reduce the torque acting on aft end of the vessel 22 causing the vessel's bow to raise compared to the stern. These actions stabilize the vessel 22 and also affect the drag by the water on the vessel 22, thereby increasing the efficiency of the operation of the vessel 22. Similar actions of the stabilizing assemblies 26 are enacted when the vessel's motion is at an angle to the waves, wherein the respective stabilizer assemblies 26 would be enacted to prevent the vessel from moving in the roll or yaw directions. The floats 38 on the stabilizer assemblies 26 are moved so as to intercept the waves parallel to the wave direction.

All computations are performed by the main control computer 32. Alternatively, separate stabilizer computers may be provided for monitoring pairs of stabilizer position sensors to provide finer controls of the floats 38, while the vessel's main control computer 32 provides coarser controls.

The optimum location and orientation of the vessel 22 and stabilizer assembly or assemblies 26 can be estimated from a variety of sources such as current sea surface observations, comparisons with the vessel's previous performance stored in the control computer 32 memory, and/or based upon empirical rules developed from past computer modeling of the vessel's behavior. Computer programs to "teach" such optimization to computers exists for other activities, using what is termed "artificial intelligence", which is equally applicable in the current invention. Such examples of utilization of this type of "artificial intelligence" include the incorporation of the same in missile guidance systems by defense agencies, and further use in exploring Martian surfaces as in the "Mars Rover" project. Other factors, such as water temperature and air wind velocity, will also appreciably affect the optimization and therefore, suitable detectors are provided on the vessel 22 to measure these conditions and send the information to the vessel's control computer 32.

While the stabilizing system 20 is described only with using the stabilizing assemblies 26 for stabilization of the marine vessel 22, other means can be incorporated into the system 20 for stabilization of the marine vessel 22. For example, the stabilizing system 20 of the present invention can be used in conjunction with wave suppression plates (not shown) located on a forward bow section of the marine vessel 22. These wave suppression plates may be similar in construction to the wave suppression plates disclosed in U.S.

Pat. No. 5,088,433, which disclosure is herein incorporated by reference. By adding multiple wave suppression plates to each side of the bow section of the marine vessel 22, and a method to move these relative to each other and to the marine vessel 22, the resistance to the forward motion of the marine vessel 22 by waves crashing onto the bow section can be reduced, while redirecting a wave impact to assist in stabilizing the marine vessel 22. For instance, when the marine vessel 22 is heading into a wave trough the wave suppression plates could redirect the wave impact toward the stabilizer assemblies 26 so as to push the bow section of the marine vessel 22 up out of the trough.

It is envisioned that the stabilizing system 20 and stabilizer assemblies 26 of the present invention could be used for other purposes in addition to stabilizing the marine vessel 22. For example, the stabilizer assemblies 26 can be used to minimize resistance to the forward motion of the vessel 22. The vessel's engines generate power which is transferred to the propellers, or alternately sails can provide a means of propulsion. In relatively calm seas, this power results in a certain velocity of the vessel 22. Sea waves moving opposite to the vessel's travel will add friction or a drag to the vessel 22, reducing its velocity. For waves with wavelengths either very short or very long compared to the vessel 22, the floats 38 on the stabilizing assembly 26 will not have much effect on this drag. For the long wavelength case, the vessel's buoyancy will keep the vessel 22 at nearly constant height relative to the local sea surface, and the vessel 22 will not experience sizeable changes in pitch.

When the wavelength is comparable to the vessel's length, the floats 38 will be useful as follows. The vessel 22 must do work to climb from a wave trough to the wave crest. The pitch of the vessel 22 changes so that the bow is eventually higher than the stern during the climb. After the crest, the vessel's angular momentum continues to raise the bow until the torque on the vessel 22 lowers the bow; this torque is from the difference in buoyancy at the bow compared to the stern from the vessel 22 moving into the trough. Near the bottom of the trough, the bow is lower than the stern and the angular momentum of the vessel 22 is in a direction to lower the bow even more. Near the bottom of the trough there is a considerable drag on the vessel 22 as the bow is low in the water and hits the beginning of the next wave. This causes a loss of much of the energy gained in the vessel 22 going down the wave. In heavy seas, the bow may be so low that the wave may crash over the bow, increasing the friction or drag even more as the water partially submerges parts of the vessel 22. The floats 38 brings the bow higher in the water when the vessel 22 is in such a trough so as to reduce the drag of the waves on the vessel 22. This allows a larger fraction of the vessel's propulsion to be used for forward motion of the vessel 22.

In addition, the stabilizing system 20 and stabilizer assemblies 26 of the present invention could be used for another purpose in addition to stabilizing the marine vessel 22 and minimizing resistance to the forward motion of the vessel 22. There may be situations where the operators of the vessel 22 may want some currents or wave motion to impact the vessel 22. Such a situation could be, for example, where the current or wave motion is traveling along with, and in the direction of, the vessel 22 resulting in a reduced fuel consumption rate of the vessel 22. Essentially, the vessel could use the currents or wave motions to assist in propelling the vessel 22 along the sea surface. Using a GPS (global positioning system) the operators of the vessel could track the position of the vessel 22 against the surface of the planet, rather then the current or wave motion itself, in order to allow the operators to target the specific area containing the desired currents or wave motion. The vessel 22 could then be navigated or directed to this area to take advantage of beneficial current or wave motions, thereby reducing fuel consumption.

Further, the stabilizer assemblies 26 can be used for propulsion purposes. The orientation of and/or height of the floats 38 can be suitably adjusting, and/or the stabilizer assemblies 26 can be moved forward or backward to obtain some propulsion of the marine vessel 22 in much the same way as a surfer does from a wave using a surfboard.

The stabilizer assemblies 26 can also be used in maneuvering the marine vessel 22 by using the stabilizer assemblies 26 as oars. The stabilizer assemblies 26 assist in turning the marine vessel 22 while it is stopped or in motion, similar to the oars of a rowboat, by suitably moving the stabilizer assemblies 26.

Yet another use for the stabilizer assemblies 26 is for marine vessel 22 protection from torpedoes. Torpedo sensors could be used to move the floats 38 to intercept a torpedo detonating the torpedo away from the hull of the marine vessel 22. Similarly, there may be some additional protection for marine vessels 22 when traveling among icebergs, the stabilizer assemblies 26 offering protection or warning from possible collision with icebergs.

While preferred embodiments of the present invention are shown and described, it is envisioned that those skilled in the art may devise various modifications of the present invention without departing from the spirit and scope of the appended claims.

The invention claimed is:

1. A method to stabilize marine vessels, said marine vessel floating on a water surface and being equipped with a gyroscope system and at least one stabilizer assembly, said method comprising the steps of:

(a) sensing ambient sea surface and atmospheric conditions relative to the position of said marine vessel as a function of time, producing condition sensor readings, to estimate wave velocity and changing wave profiles relative to said marine vessel;

(b) referencing said condition sensor readings with vessel orientation readings provided by said gyroscopic system to account for differences in sensor orientation as the pitch, roll, and yaw of said marine vessel changes with respect to time;

(c) sensing the positions of said at least one stabilizer assembly relative to said marine vessel to produce position sensor readings;

(d) inputting said condition sensor readings, gyroscopic system readings and said position sensor readings into a control computer provided on said marine vessel;

(e) analyzing said condition sensor readings, said gyroscopic system readings, and said position sensor readings in said control computer to produce computer data for determining the optimum location of said marine vessel and orientation of said at least one stabilizer assembly relative to sea surface conditions as a function of time;

(f) positioning said marine vessel and said at least one stabilizer assembly to optimum positions to effectively negate adverse sea surface conditions thereby stabilizing said marine vessel; and, (g) repeating steps (a) through (f) at predetermined intervals so as to provide for the continuous stabilization of said marine vessel.

2. A method as recited in claim 1, further including the step of comparing current computer data in step (e) to previous computer data in step (e) at predetermined intervals to estimate wave velocity relative to said marine vessel and changing wave profiles to give an accurate average wave velocity relative to said marine vessel.

3. A stabilizing system used for stabilizing a marine vessel floating upon a sea surface, comprising:

at least one stabilizer assembly, said at least one stabilizer assembly having an individual position in relation to said marine vessel;

at least one position sensor, said position sensor sensing the position of the stabilizer relative to said marine vessel to produce position sensor readings;

at least one condition sensor, said condition sensor having the capability of sensing ambient sea surface and atmospheric conditions relative to the position of said marine vessel as a function of time in order to estimate wave velocity and changing wave profiles relative to said marine vessel, producing condition sensor readings;

a gyroscopic system, said gyroscopic system accounting for differences in sensor orientation as the pitch, roll, and yaw of said marine vessel changes with respect to time, producing gyroscopic readings;

a control computer, said control computer processing said condition sensor readings, said gyroscopic readings, and said position sensor readings together as a function of time into data to produce a series of commands;

means for transmitting said condition sensor readings, said gyroscopic readings, and said position sensor readings to said control computer; and means for transmitting said series of commands to said marine vessel and said at least one stabilizer assembly to position said marine vessel and said at least one stabilizer assembly to optimum positions to effectively negate adverse sea surface conditions resulting in the stabilization of said marine vessel.

4. A stabilizing system as defined in claim 3, wherein said sea surface condition readings are compared to previous sea surface condition readings at predetermined intervals to estimate wave velocity relative to said marine vessel and changing wave profiles to give an accurate average wave velocity relative to said marine vessel.

5. A stabilizing system as defined in claim 3, wherein the condition sensors are comprised of at least one of: an infrared camera system, a radar system, or a sonar system.

6. A stabilizing system as defined in claim 3, wherein said condition sensors are located about said marine vessel at positions allowing unobstructed viewing areas for said condition sensors.

7. A stabilizing system as defined in claim 3, wherein to each said stabilizer assembly comprises an adjustable outrigger arm extending generally laterally from and operatively connected to said marine vessel hull; a downwardly extending float arm operatively connected to said outrigger arm at a junction; a float operatively connected to said float arm at a position opposite said junction; means to allow limited yaw, roll, and pitch movement of said float in response to a command; means for moving said float with respect to said marine vessel; at least one support arm operatively connected to said outrigger arm from said marine vessel hull; and, means for mounting and operatively connecting said outrigger arm and said support arm to said marine vessel hull.

8. A stabilizing system as defined in claim 7, wherein each said stabilizer assembly further includes at least two support arms, said support arms having structure for contracting or expanding interdependently, allowing for motion of said outrigger arm, said float arm, and said float in relation to said marine vessel hull.

9. A stabilizing system as defined in claim 7, wherein said float arm has a float arm axis, said float arm having structure for contracting or expanding to allow for motion of said float along said float arm axis.

10. A stabilizing system as defined in claim 7, wherein said float arm has a float arm axis, said float arm having structure for rotating said float around said float arm axis in yaw direction.

11. A stabilizing system as defined in claim 7, wherein said float has a roll and a pitch plane, said float having structure within said float allowing said float to move along said roll and pitch planes.

12. A stabilizing system as defined in claim 7, further including a reinforcing arm having opposite ends, one end of said reinforcing arm being operably connected to said junction between said float arm and said outrigger arm, and the opposite end of said reinforcing arm being operably connected to said marine vessel hull.

13. A stabilizing system as defined in claim 7, wherein said float is comprised of a watertight flexible bladder having means therein to change the shape, cross-section, and volume of said bladder.

14. A stabilizing system as defined in claim 7, further including at least one position sensor associated with said float to provide position sensor readings of said float position relative to said marine vessel.

15. A stabilizer assembly for use with a stabilizer system on a marine vessel hull comprising:

an adjustable outrigger arm extending generally laterally from and operatively connected to said marine vessel hull;

a downwardly extending float arm operatively connected to said outrigger arm at a junction;

a float operatively connected to said float arm at a position opposite said junction;

means to allow limited yaw, roll, and pitch movement of said float in response to a command;

means for moving said float with respect to said marine vessel;

at least one support arm operatively connected to said outrigger arm from said marine vessel hull; and, means for mounting and operatively connecting said outrigger arm and said support arm to said marine vessel hull.

16. A stabilizer assembly as defined in claim 15, wherein said stabilizer assembly includes at least two support arms, said support arms having structure for contracting or expanding interdependently, allowing for motion of said outrigger arm, said float arm, and said float in relation to said marine vessel hull.

17. A stabilizer assembly as defined in claim 15, wherein said float arm has a float arm axis, said float arm having structure for contracting or expanding to move said float along said float arm axis.

18. A stabilizer assembly as defined in claim 15, wherein said float arm has a float arm axis, said float arm having structure for rotating said float around said float arm axis in yaw direction.

19. A stabilizer assembly as defined in claim 15, wherein said structure in said float arm permits movement of said float around said float arm axis in the yaw direction.

20. A stabilizing assembly as defined in claim 15, wherein said float has a roll and a pitch plane, said float having structure within said float allowing said float to move along said roll and pitch planes.

21. A stabilizer assembly as defined in claim 15, further including a reinforcing arm having opposite ends, one end of said reinforcing arm being operably connected to said junction between said float arm and said outrigger arm, and the opposite end of said reinforcing arm being operably connected to said marine vessel hull.

22. A stabilizer assembly as defined in claim 15, wherein said float is comprised of a watertight flexible bladder having means therein to change the shape, cross-section, and volume of specific sections of said bladder.

23. A stabilizing assembly as defined in claim 15, further including at least one position sensor associated with said float to provide position sensor readings of said float position relative to said marine vessel.

* * * * *

UNITED STATES PATENT AND TRADEMARK OFFICE

CERTIFICATE OF CORRECTION

PATENT NO. : 5,787,832

DATED : August 4, 1998

INVENTOR(S) : Harold Spinka

It is certified that error appears in the above-indentified patent and that said Letters Patent is hereby corrected as shown below:

Column 19, Line 48 "brings" should be -- bring --

Column 21, Line 52 "wherein to" should be -- wherein --

Signed and Sealed this

Twenty-third Day of February, 1999

*Attest:*

*Attesting Officer*

Q. TODD DICKINSON

*Acting Commissioner of Patents and Trademarks*